US012122549B2

(12) United States Patent
Tan

(10) Patent No.: US 12,122,549 B2
(45) Date of Patent: Oct. 22, 2024

(54) APPARATUS AND METHOD FOR INSERTING AND UNLOADING STACKED GLOVES INTO A PACKING BOX

(71) Applicant: AT SYSTECH SDN BHD, Selangor (MY)

(72) Inventor: Kelvin Weng Liang Tan, Rawang (MY)

(73) Assignee: AT SYSTECH SDN BHD, Rawang (MY)

( * ) Notice: Subject to any disclaimer, the term of this patent is extended or adjusted under 35 U.S.C. 154(b) by 201 days.

(21) Appl. No.: 17/994,829

(22) Filed: Nov. 28, 2022

(65) Prior Publication Data

US 2024/0043157 A1 Feb. 8, 2024

(30) Foreign Application Priority Data

Aug. 8, 2022 (MY) ..... PI 2022004218

(51) Int. Cl.

| | |
|---|---|
| ***B65B 35/44*** | (2006.01) |
| ***B65B 5/06*** | (2006.01) |
| ***B65B 63/02*** | (2006.01) |
| ***B65B 65/00*** | (2006.01) |

(52) U.S. Cl.

CPC ..... *B65B 65/003* (2013.01); *B65B 5/06* (2013.01); *B65B 35/44* (2013.01); *B65B 63/02* (2013.01)

(58) Field of Classification Search

USPC ..... 53/473

See application file for complete search history.

(56) References Cited

U.S. PATENT DOCUMENTS

| | | | | |
|---|---|---|---|---|
| 5,473,862 | A * | 12/1995 | Brizzi | B65B 17/02 53/136.3 |
| 2004/0148912 | A1* | 8/2004 | Lambrecht | B65B 25/141 53/473 |
| 2016/0031573 | A1* | 2/2016 | Davis | B65B 35/50 53/147 |
| 2016/0229567 | A1* | 8/2016 | Schmachtel | B65B 35/50 |
| 2018/0002047 | A1* | 1/2018 | Austermeier | B65B 35/44 |

* cited by examiner

*Primary Examiner* — Chinyere J Rushing-Tucker

(74) *Attorney, Agent, or Firm* — FRESH IP PLC; Clifford D. Hyra; Aubrey Y. Chen

(57) ABSTRACT

Disclosed herein is an apparatus for inserting and unloading a stacked gloves into a packing box. The apparatus may include an upper belt conveyor driven by a servo motor with a dual function rotary clamp cylinder at the shorter side to facilitate both rotating and lifting function; a bottom belt conveyor as a loading platform for the stacked gloves located below the upper belt conveyor which is driven by a servo motor; supported at the bottom by a compact guide cylinder to facilitate lifting and compressing function. Further, the entire bottom belt conveyor, servo motor and compact guide cylinder is may be mounted proximately to the rotary clamp cylinder. Also disclosed is a method for inserting and unloading a stacked gloves into a packing box without inducing friction.

5 Claims, 11 Drawing Sheets

APPARATUS AND METHOD FOR INSERTING AND UNLOADING STACKED GLOVES INTO A PACKING BOX

This invention relates to an apparatus and method for inserting and unloading stacked gloves into a packing box, more especially, automation inserting and unloading stacked gloves into a packing box.

BACKGROUND OF THE INVENTION

CN 202728596 U discloses a device for quickly sending finished gloves into packing boxes, which comprises a glove transition box and a transition box support groove, wherein the glove transition box is provided with a movable cover plate and installed on inner guide rails on both sides of the transition box support groove; an outer guide rail is arranged on one end of the transition box support groove, a transition box drive cylinder and a glove stopper drive cylinder are arranged on the other end of the transition box support groove, and the glove stopper drive cylinder is provided with a glove stopper. When the device is operated, the gloves are compressed and stacked into a tube structure which is formed by the glove transition box and the movable cover plate, wherein openings are formed in both ends of the tube structure, and the periphery of the tube structure is sealed; then the glove transition box is pushed into the glove packing boxes by the transition box drive cylinder, and the glove stopper is controlled by the glove stopper drive cylinder to block the gloves; and finally, the glove transition box is pulled out, so that the gloves are kept in the glove packing boxes.

Existing art has a number of drawbacks that have yet been addressed. In the event that groups of gloves are to be packaged in boxes, a fixed number of gloves are stacked before being packaged. During the pulling of transition box, there will be gloves pull out with the transition box. This happens due to friction between the stacked gloves and the transition box. Besides, the gloves and packing box can be damaged during the pulling of transition box. Damage occurs in the existing art when gloves stick in transition box or pulling direction got mistake. Furthermore, improper layout of stacked gloves in packing box can cause difficulty in closing of box.

SUMMARY OF THE INVENTION

The above-mentioned drawbacks are overcome, and improvements are achieved, by the present invention which introduce conveyor system to avoid the friction of the unloading between the stacked gloves to the conveyor system and the conveyor system to the packing box, the damage of the gloves and packing box can also be prevented.

Embodiments of the present disclosure provide an apparatus for inserting and unloading stacked gloves into a packing box, comprising a first embodiment consists of; an upper belt conveyor driven by a servo motor with a dual function rotary clamp cylinder at the shorter side to facilitate both rotating and lifting function; a bottom belt conveyor as a loading platform for the stacked gloves located below the upper belt conveyor which is driven by a servo motor; supported at the bottom by a compact guide cylinder to facilitate lifting and compressing function; wherein the entire bottom belt conveyor, servo motor and compact guide cylinder is mounted proximately to the rotary clamp cylinder; upon the first embodiment insert to the desire depth of the packing box, both the servo motor will initial the rotating of the upper belt conveyor in anti-clockwise direction while the bottom belt conveyor in the opposite direction (clockwise direction) to create a push force to the stacked gloves out from the belt conveyor into the packing box which achieve the objectives of the disclosure.

Embodiments of the present disclosure provide a method for inserting and unloading a stacked gloves of a first embodiment into a packing box, comprising steps of inserting the stacked gloves into the packing box; unloading the stacked gloves with the upper belt conveyor rotating in anti-clockwise direction while the bottom belt conveyor rotating in the opposite direction (clockwise direction), to push out the stacked gloves without inducing friction between the stacked gloves to the belt conveyors and from the belt conveyors to the packing box during unloading to prevent damage; lifting the first embodiment without the stacked gloves from the packing box simultaneously with unloading while the stacked gloves being push into the packing box; and the first embodiment return to its initial position and thereafter the process for inserting, unloading and lifting repeat.

BRIEF DESCRIPTION OF THE DRAWINGS

The features of the invention will be more readily understood from the following detailed description with reference to the accompanying drawing, in which.

DETAILED DESCRIPTION

Figure 1:
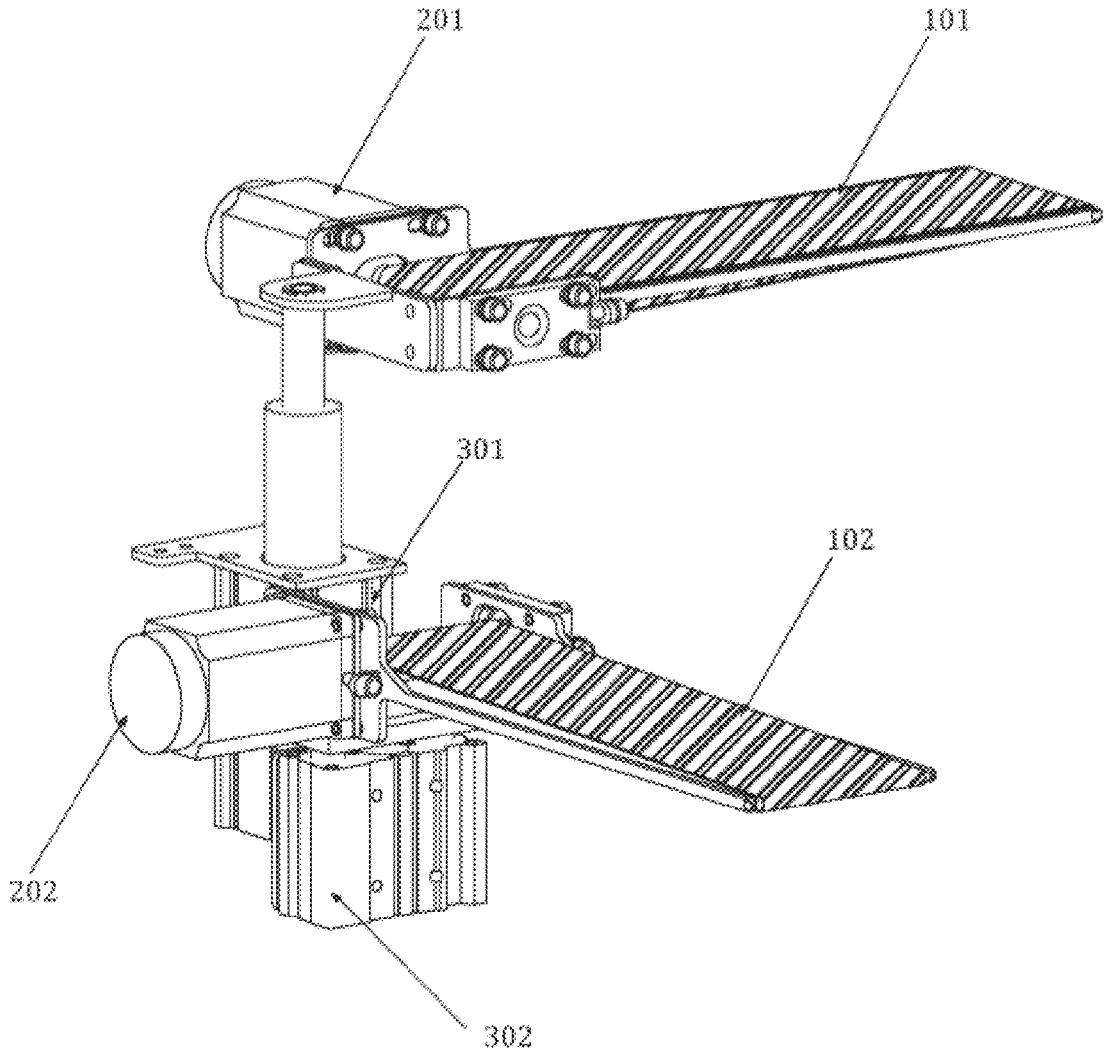
FIG. 1 is a perspective view of the first embodiment of an apparatus, according to at least one embodiment of the disclosure, the conveyor system, in open position, also known as initial position.

Embodiment of the present disclosure will now be described more detailed hereinafter with the reference to the accompanying drawings, in which not all the embodiments of the invention are shown. Indeed, the invention may be embodied in many different forms and should not be constructed or construed as limited to the embodiments set forth herein: rather these embodiments are provided so that this disclosure will satisfy applicable legal requirements. Like reference numerals refer to like elements throughout, the preferred embodiment of the invention may also be designed for use with other sizes and types of stacked gloves, packing box, cylinders and motors.

Figure 2:
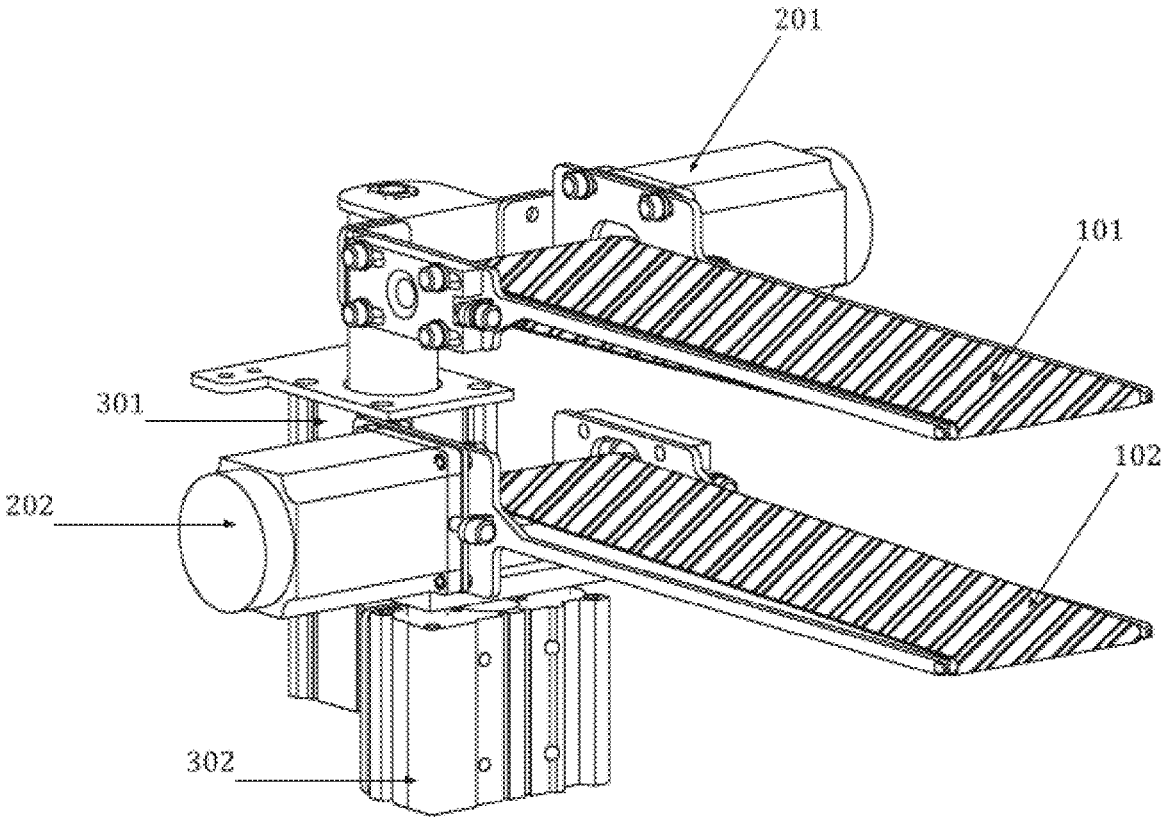
FIG. 2 is a perspective view of the first embodiment of an apparatus, according to at least one embodiment of the disclosure, the conveyor system, in close position.
Figure 3:
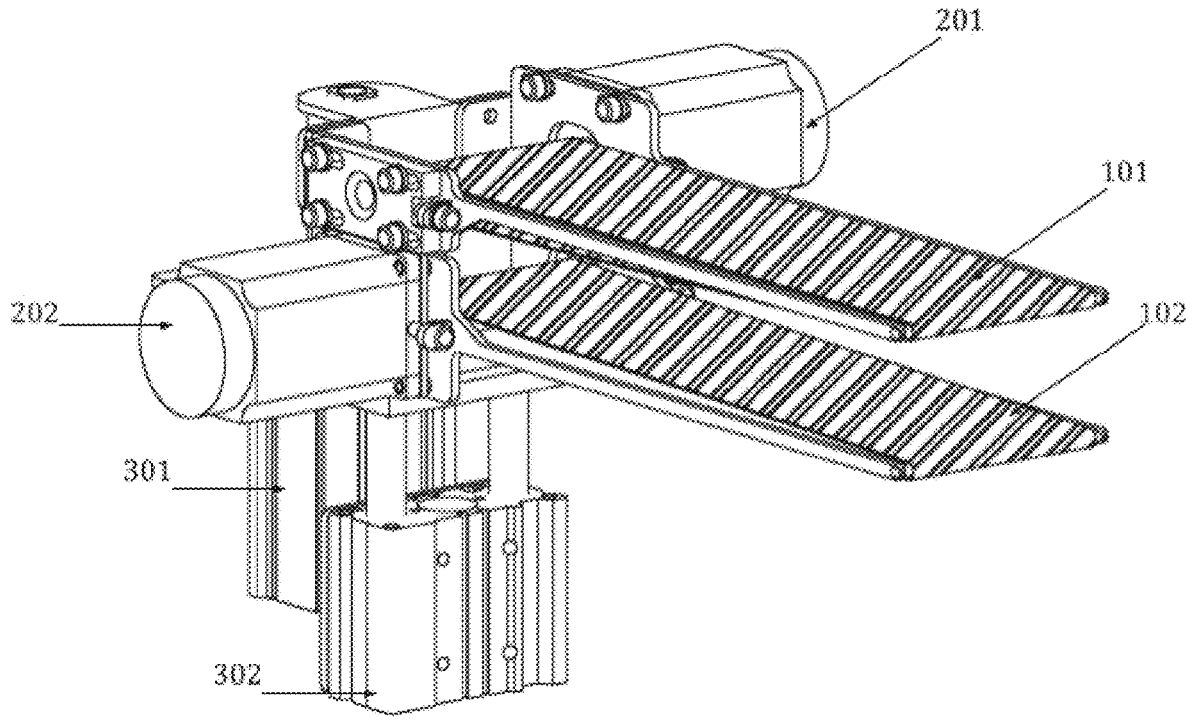
FIG. 3 is a perspective view of the first embodiment of an apparatus, according to at least one embodiment of the disclosure, the conveyor system, in close and compress position.
Figure 4:
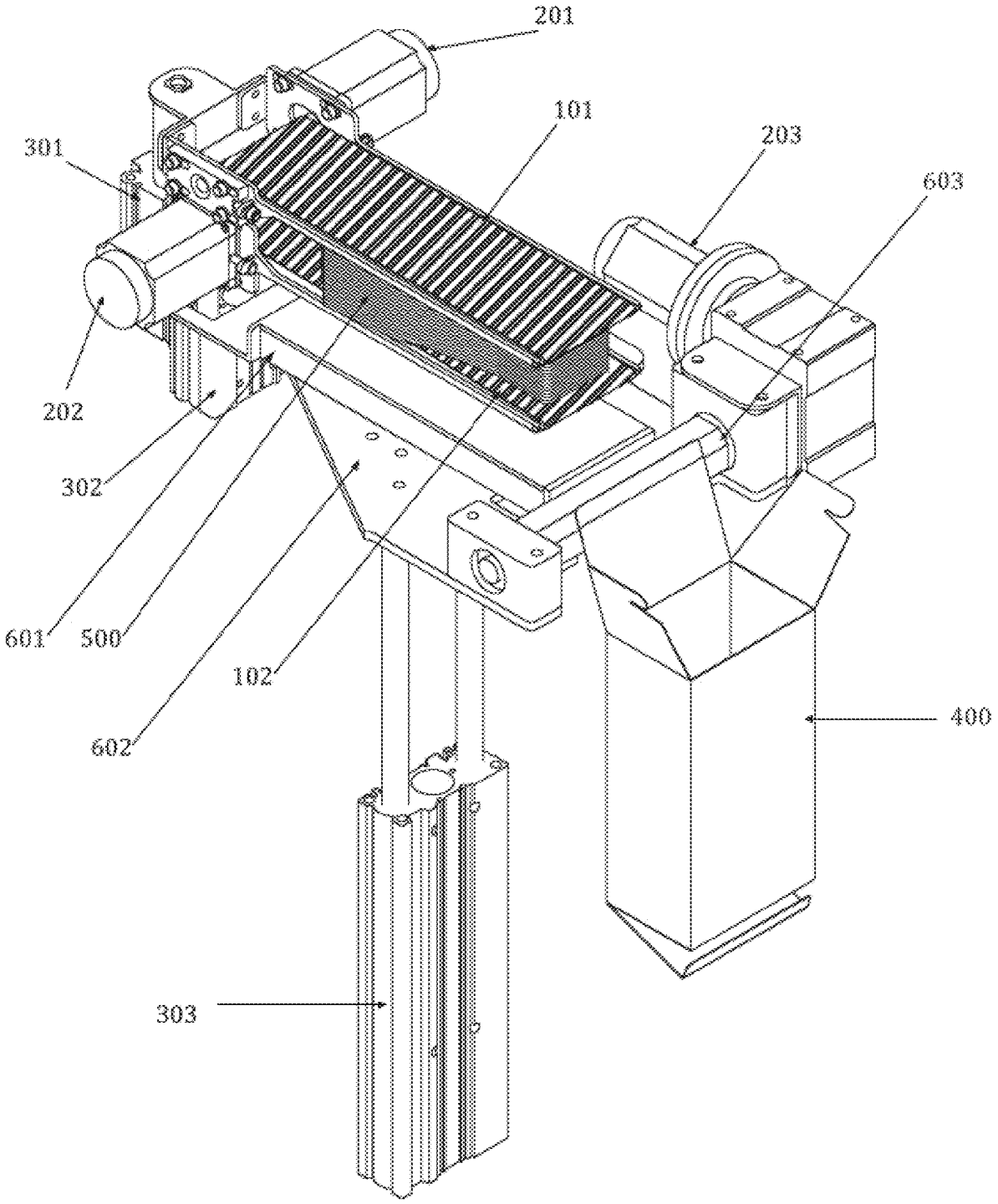
FIG. 4 is a perspective view of the combination of first and second embodiment with stacked gloves, perpendicular to a packing box.
Figure 5:
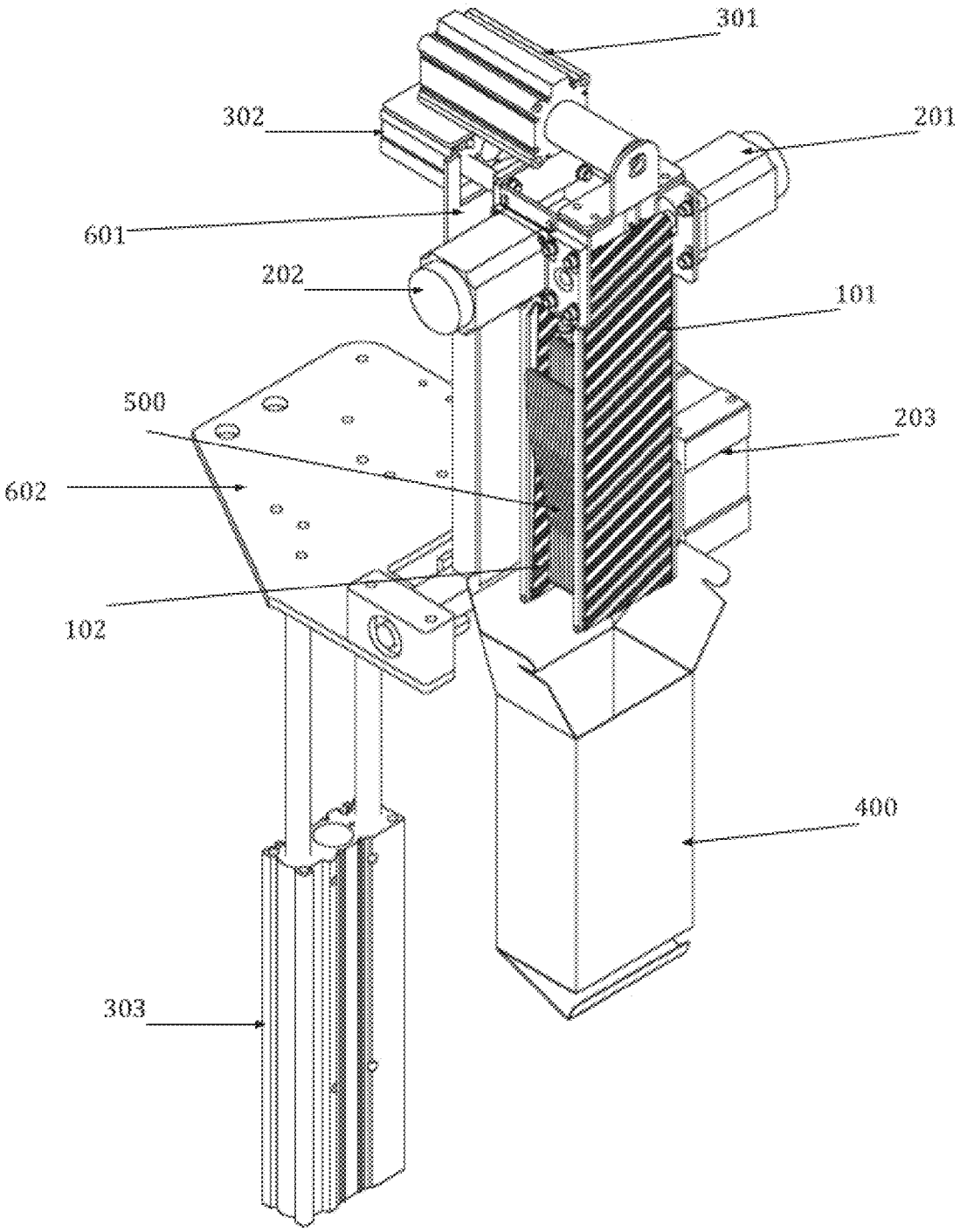
FIG. 5 is a perspective view of the combination of first and second embodiment with stacked gloves, wherein the first embodiment being lifted up in vertical position, above the packing box.
Figure 6:
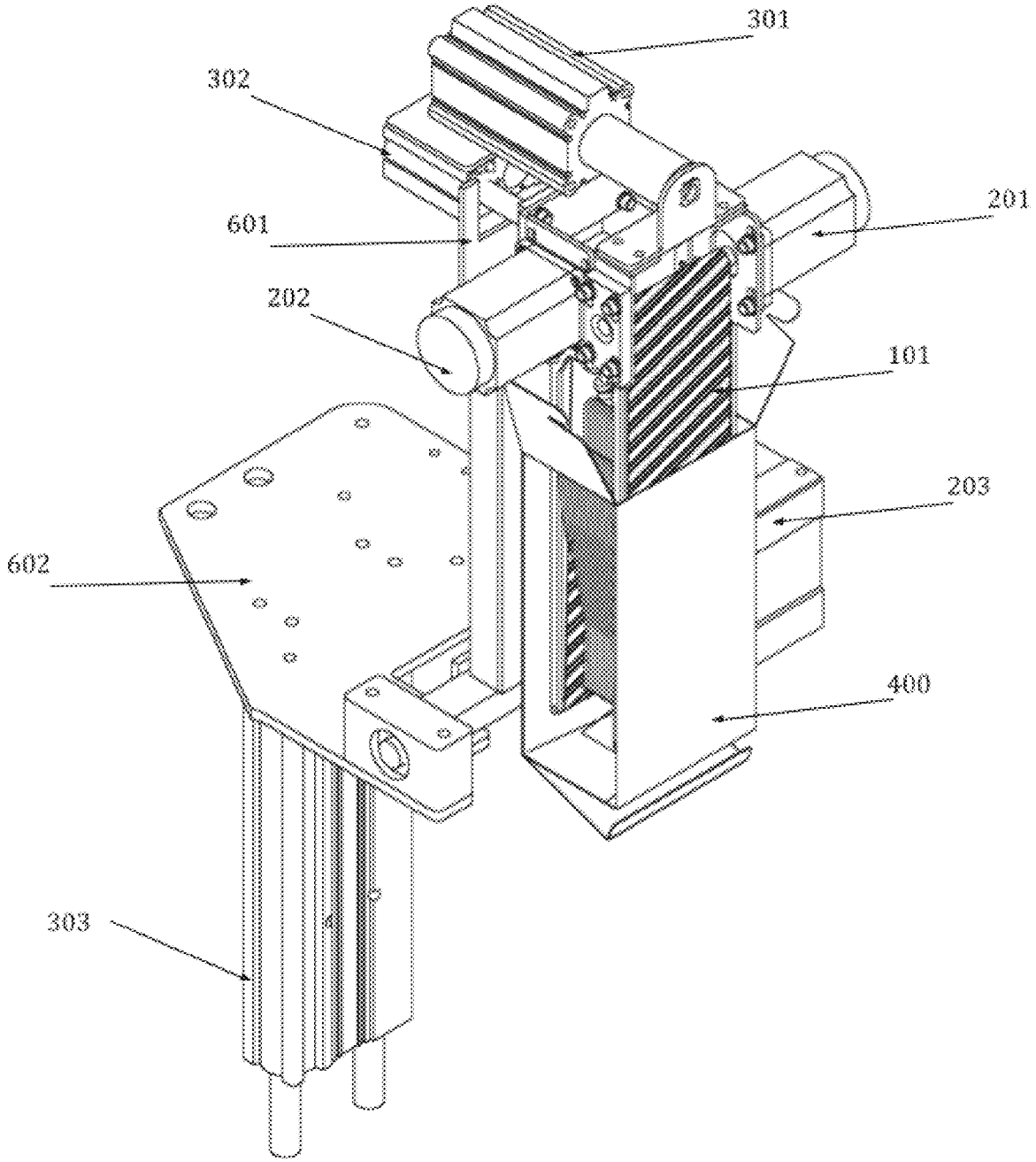
FIG. 6 is a perspective view of the combination of first and second embodiment with stacked gloves, wherein the first embodiment inserting into the packing box.
Figure 7:
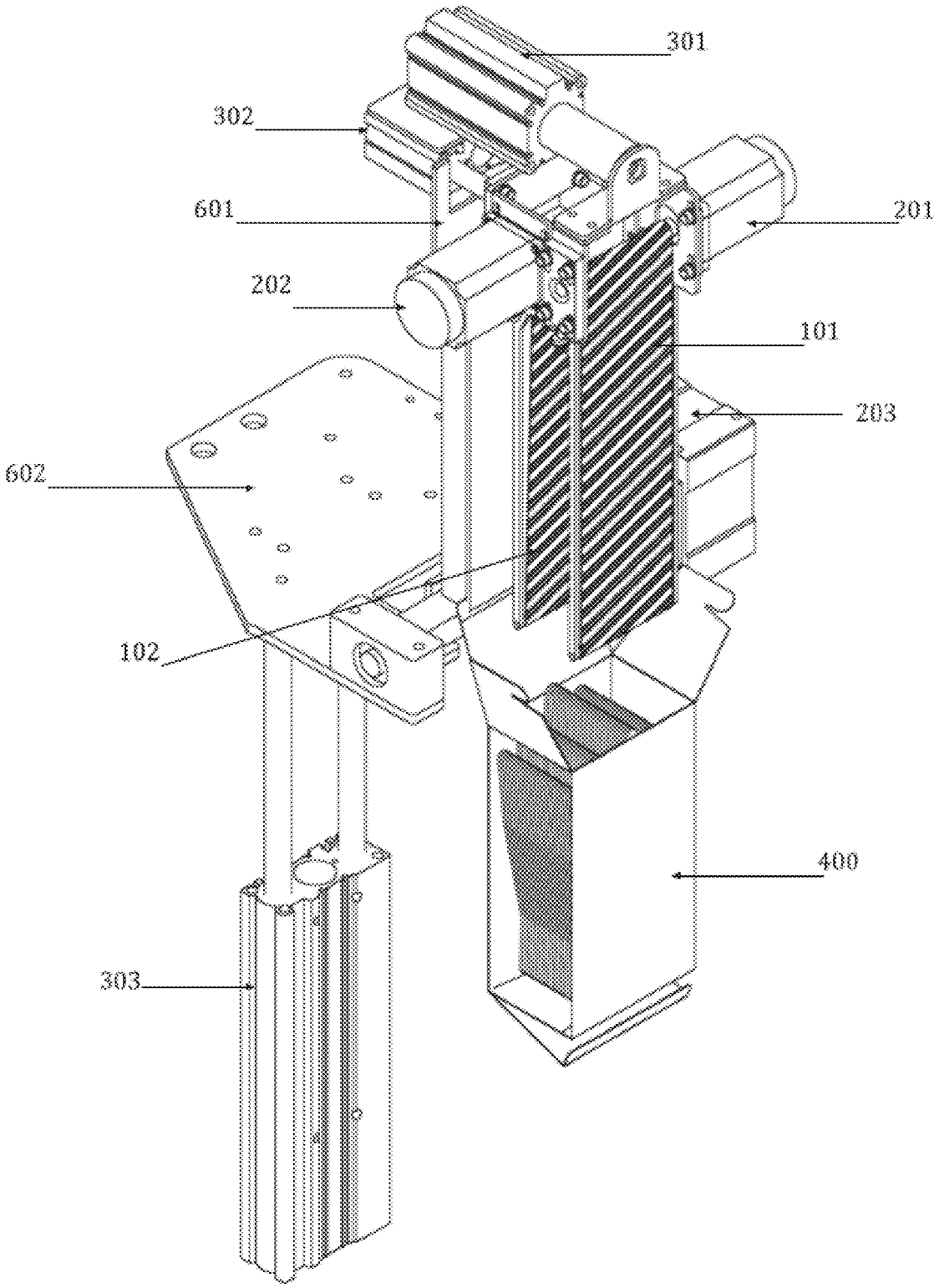
FIG. 7 is a perspective view of the combination of first and second embodiment, with first embodiment lifted up away from the packing box, wherein the stacked gloves remain inside the packing box.

As shown in FIG. 1 to FIG. 3, a first embodiment consists of; an upper belt conveyor 101 driven by a servo motor 201 with a dual function rotary clamp cylinder 301 at the shorter side to facilitate both rotating and lifting function such that when the rotary clamp cylinder 301 rotating, the entire upper belt conveyor 101 turn to create sufficient open space to enable the loading of the stacked gloves 500 to the bottom belt conveyor 102, and rotate again to return to close position; when the rotary clamp cylinder 301 lifting firstly to level up and down according the height and the quantity of the stacked gloves 500, secondly to further move downward to compress the stacked gloves 500 from the top and return upward back to initial position; and a bottom belt conveyor 102 as a loading platform for stacked gloves 500 located below the upper belt conveyor 101 which is driven by a servo motor 202 supported at the bottom by a compact guide cylinder 302 to move vertically up to compress the stacked gloves 500 from the bottom side to hold the stacked gloves 500 firmly in between the upper belt conveyor 101 and the bottom belt conveyor 102; move down to return to the initial position; the entire bottom belt conveyor 102, servo motor 202 and compact guide cylinder 302 is mounted proximately to the rotary clamp cylinder 301.

As shown in FIG. 4 to FIG. 7, the combination of the first embodiment (as shown in FIG. 1 to FIG. 3) and a second embodiment, which consists of; a base plate 601 function as a connecting plate between the first embodiment and the second embodiment; with one end mounted to the first embodiment proximately to the rotary clamp cylinder 301; a pivot shaft 603 that mounted with the base plate 601, driven by a servo motor 203 to rotate and to lift up the base plate 601 connecting with the first embodiment to align to insert position above the packing box 400 at opening end; a base plate 602 with surface mounted on the pivot shaft 603 at the edge and supported at the bottom with a compact guide cylinder 303 to facilitate the vertical movement of the connecting base plate 601; a compact guide cylinder 303 connected above with the base plate 602 to facilitate the vertical movement downward to insert the first embodiment into the packing box 400 and return upward to initial position; such that when the compact guide cylinder 303 move downward to insert the compress stacked gloves 500 hold in between the first embodiment into the packing box 400; upon inserting to the desire depth of the packing box 400, both the servo motor 201 and 202 will initial the rotating of the upper belt conveyor 101 in anti-clockwise direction while the bottom belt conveyor 102 in the opposite direction (clockwise direction) to create a push force to the stacked gloves 500 out from the belt conveyor 101, 102 into the packing box 400; the movement synchronize with the compact guide cylinder 303 to move the base plate 602 vertically upward away from the packing box 400 to unload the entire stacked gloves 500 remain inside the packing box 400; wherein the state of the first embodiment shall empty without the stacked gloves 500; thereafter the servo motor 203 will rotate the base plate 601 to initial position; the upper belt conveyor 101 will return to initial open position waiting for the next loading of the stacked gloves 500; the packing box 400 filled with the stacked gloves 500 will move to the next packing process to vacant the packing box station and replace with a new empty packing box 400; the above sequence will repeat continually to insert another stacked gloves 500 into the next empty packing box 400.

Figure 8:
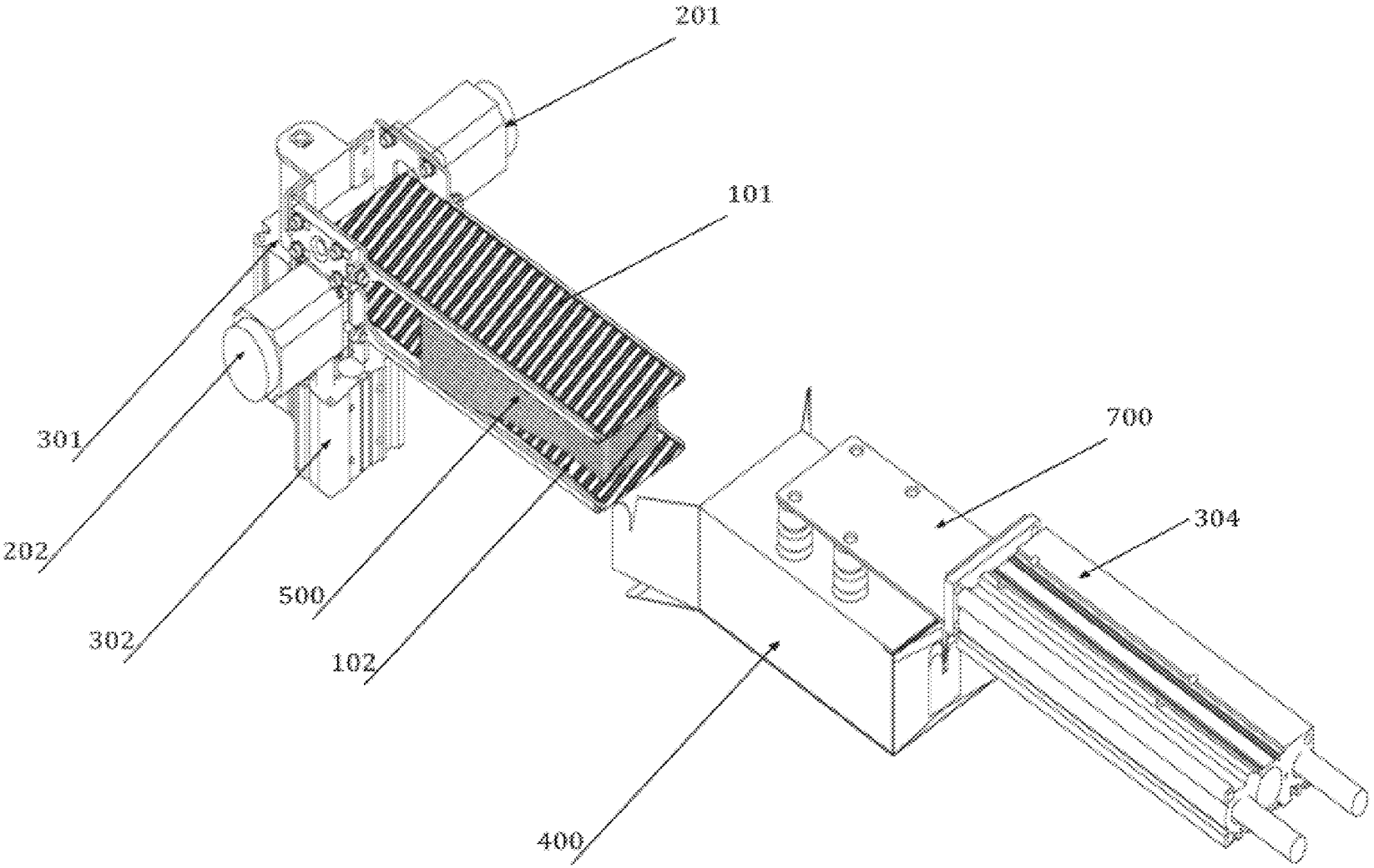
FIG. 8 is a perspective view of first embodiment with stacked gloves, horizontal to the packing box.
Figure 9:
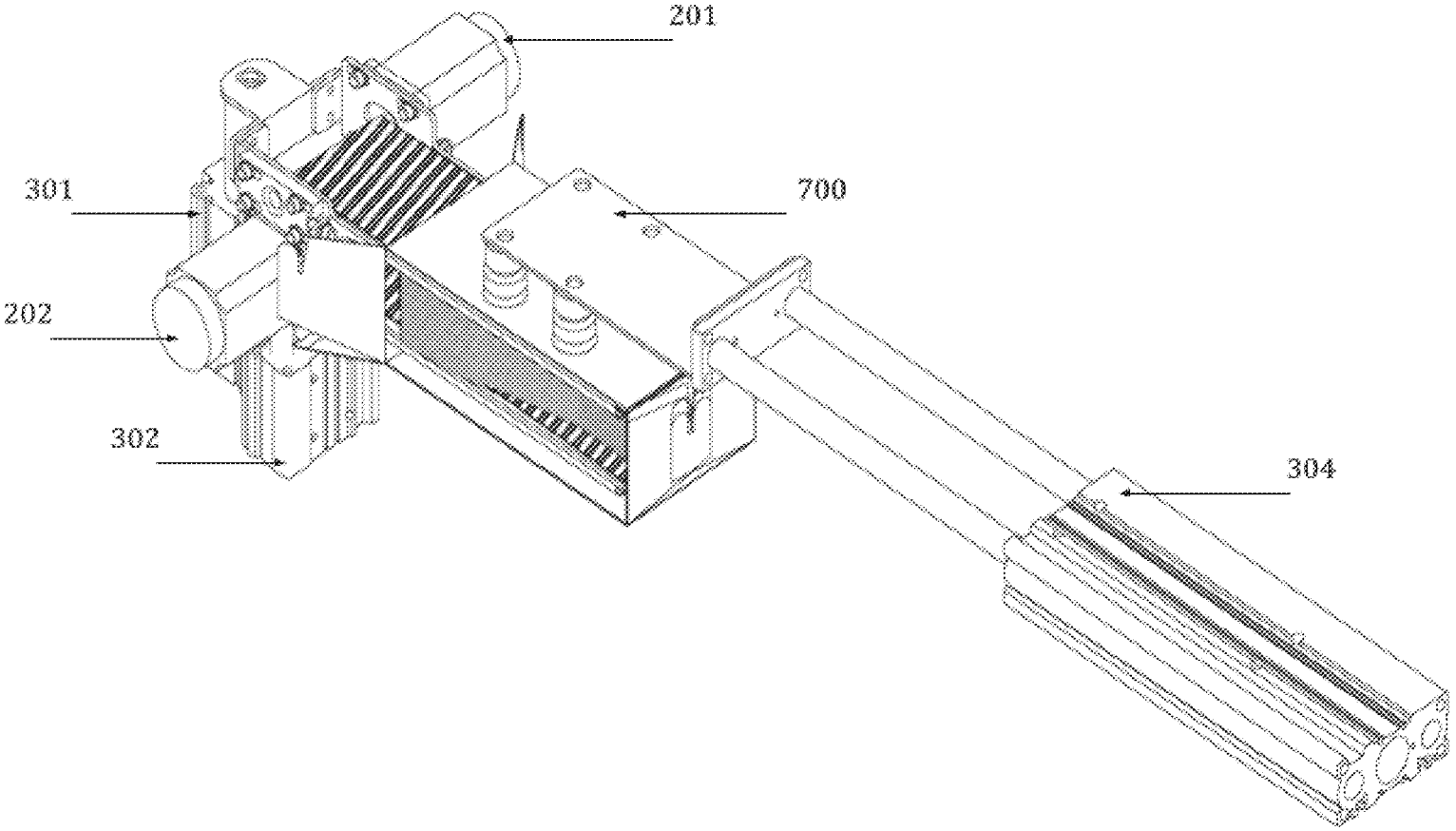
FIG. 9 is a perspective view of first embodiment with stacked gloves, wherein the packing box move toward the first embodiment.
Figure 10:
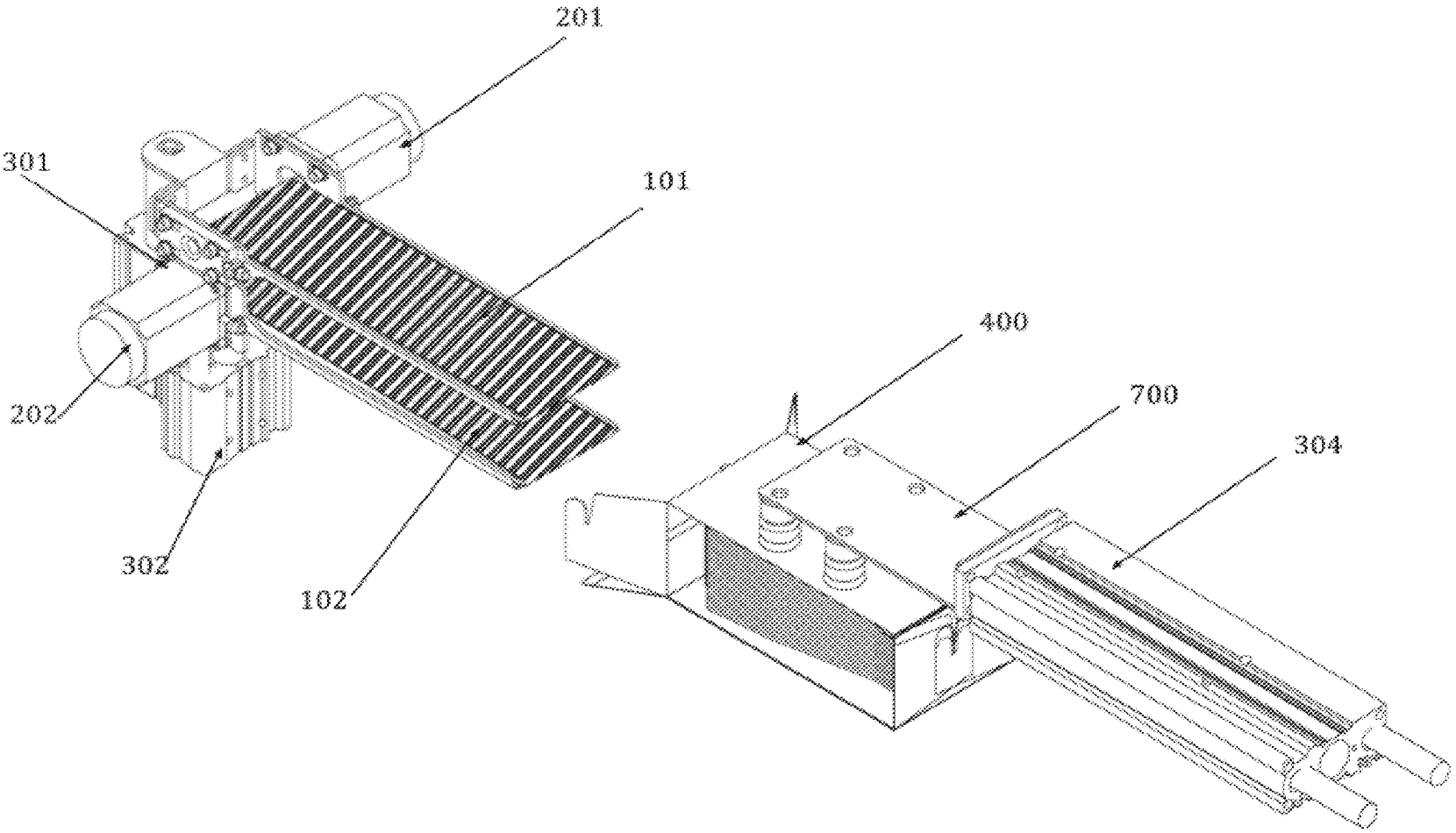
FIG. 10 is a perspective view of first embodiment without stacked gloves, wherein the packing box move away from the first embodiment with stacked gloves remain inside the packing box.

Referring to FIG. 8 to FIG. 10, wherein the packing box 400 hold by a robotic arm 700 that mounted with a compact guide cylinder 304 in horizontal mode; the first embodiment with the stacked gloves 500 facing toward the packing box 400 opening end; such that when the compact guide cylinder 304 move toward the first embodiment with the stacked gloves 500 into the packing box 400; upon inserting to the desire depth of the packing box 400, both the servo motor 201 and 202 will initial the upper and bottom belt conveyor 101 and 102 to rotate anticlockwise (in difference direction) to push out the stacked gloves from the belt conveyor 101, 102 into the packing box 400, the belt conveyor 101, 102 rotating movement synchronize with the compact guide cylinder 304 movement to unload the entire stacked gloves 500 into the packing box 400; wherein the state of the first embodiment shall empty without the stacked gloves 500; thereafter the upper belt conveyor 101 will return to initial open position waiting for the next loading of the stacked gloves 500; the packing box 400 filled with the stacked gloves 500 will move to the next packing process to vacant the packing box station and replace with a new empty packing box 400; the above sequence will repeat continually to insert another stacked gloves 500 into the next empty packing box 400.

Figure 11:
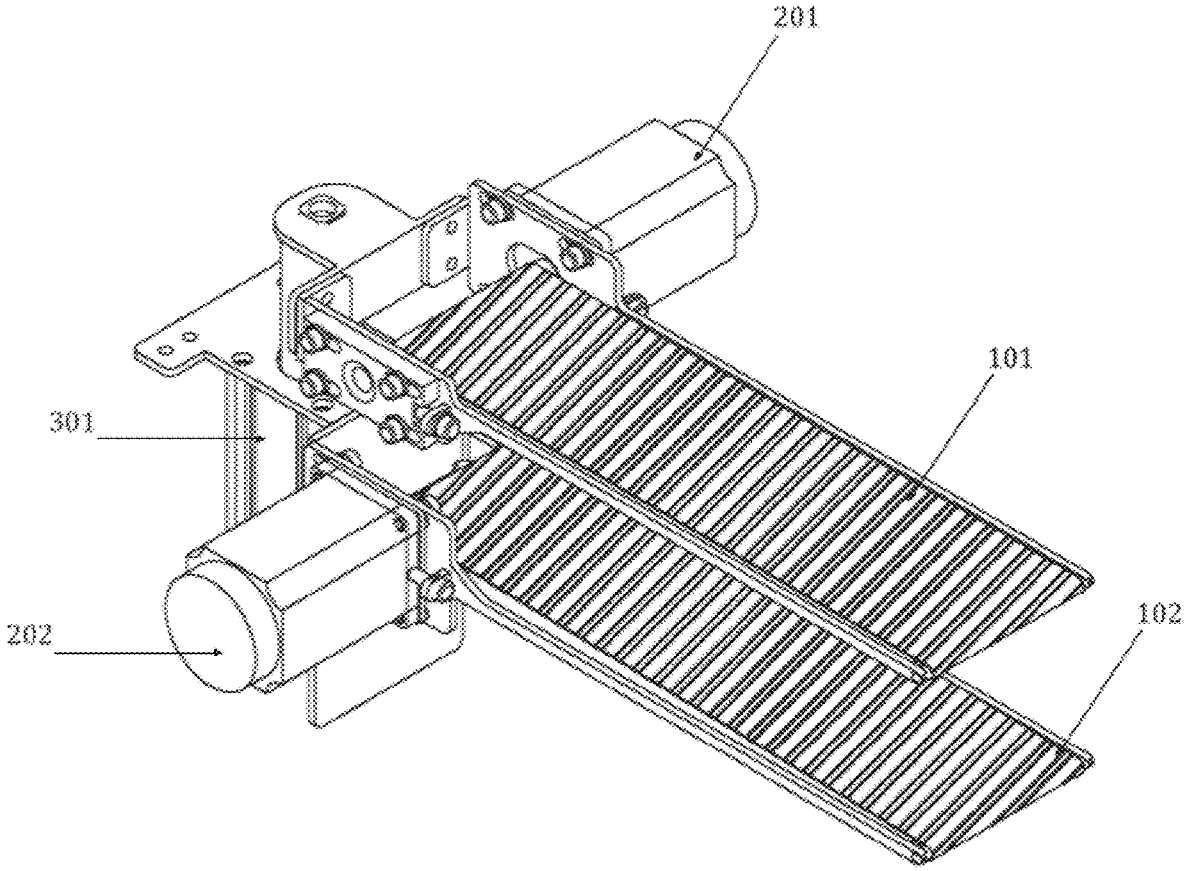
FIG. 11 is a perspective view of an alternative of first embodiment with only rotary clamp cylinder.

Referring to FIG. 11, an alternative of the first embodiment wherein the bottom belt conveyor 102 driven by a servo motor 202 can mounted proximately to the rotary clamp cylinder 301; such that when further compress motion of the stacked gloves 500 is not required.

Another aspect of at least one embodiment of the disclosure provides a method for inserting and unloading a stacked gloves 500 of a first embodiment into a packing box 400, comprising steps of: inserting the stacked gloves 500 into the packing box 400; unloading the stacked gloves 500 with the upper belt conveyor 101 rotating in anti-clockwise direction while the bottom belt conveyor 102 rotating in the opposite direction (clockwise direction), to push out the stacked gloves 500 without inducing friction between the stacked gloves 500 to the belt conveyors 101, 102 and from the belt conveyors 101, 102 to the packing box 400 during unloading to prevent damage; lifting the first embodiment without the stacked gloves 500 from the packing box simultaneously with unloading while the stacked gloves 500 being push into the packing box 400; and the first embodiment return to its initial position and thereafter the process for inserting, unloading and lifting repeat.

An alternative method, inserting and unloading with a packing box 400 moving toward the first embodiment.

The invention claimed is:

1. An apparatus for inserting and unloading stacked gloves into a packing box, the apparatus comprising:

a first portion comprising:

an upper belt conveyor driven by a first servo motor with a dual function rotary clamp cylinder at a shorter side to facilitate both rotating and lifting;

a bottom belt conveyor to be a loading platform for the stacked gloves, the bottom belt conveyor located below the upper belt conveyor and being driven by a second servo motor, the bottom belt conveyor being supported at the bottom by a first compact guide cylinder to facilitate lifting and compressing;

wherein an entirety of the bottom belt conveyor, the second servo motor, and the first compact guide cylinder is mounted proximately to the rotary clamp cylinder; and a second portion comprising:

a first base plate that is a connecting plate between the first portion and the second portion, wherein one end of the first base plate is mounted to the first portion proximately to the rotary clamp cylinder;

a pivot shaft mounted with the first base plate, the pivot shaft driven by a third servo motor to rotate and lift up the first base plate connected with the first portion, thereby aligning the first base plate to be in a position above the packing box at an opening end;

a second base plate with a surface mounted on the pivot shaft at an edge and supported at the bottom with a second compact guide cylinder to facilitate vertical movement of the first base plate;

wherein the second compact guide cylinder is connected with the second base plate to facilitate vertical movement downward to insert the first portion into the packing box and return the first portion upward to an initial position;

such that:

(i) when the rotary clamp cylinder rotates, an entirety of the upper belt conveyor turns to create open space to enable loading of the stacked gloves to the bottom belt conveyor, and to rotate again to return to a closed position;

(ii) the rotary clamp cylinder lifts to level up and down according a height and a quantity of the stacked gloves, and to further move downward to compress the stacked gloves from the top and return upwards back to an initial position;

(iii) when the second compact guide cylinder moves downward to insert the compress stacked gloves hold in between the first portion into the packing box; and upon inserting to a predetermined depth of the packing box, both the first servo motor and the second servo motor initiate rotation of the upper belt conveyor in an anti-clockwise direction while the bottom belt conveyor moves in an opposite, clockwise direction, thereby generating a force on the stacked gloves out from the upper belt conveyor and the lower belt conveyor into the packing box, such movement synchronizing with the second compact guide cylinder to move the second base plate vertically upward away from the packing box to unload an entirety of the stacked gloves that remain inside the packing box, wherein the state of the first portion shall empty without the stacked gloves, and wherein the third servo motor rotates the first base plate to an initial position and the upper belt conveyor returns to an initial open position to wait for a subsequent loading of the stacked gloves;

(iv) the packing box filled with the stacked gloves moves to the next packing process to vacate a packing box station and replace with a new empty packing box;

wherein (i) through (iv) repeat continuously to insert another stacked gloves into the next empty packing box.

2. The apparatus of claim 1, alternative inserting and unloading with a packing box moving toward the first portion, wherein the packing box is held by a robotic arm mounted with a third compact guide cylinder in horizontal mode, wherein the first portion with the stacked gloves faces toward the packing box opening end such that the third compact guide cylinder moves toward the first portion with the stacked gloves into the packing box.

3. The apparatus of claim 1, an alternative of the first portion wherein the bottom belt conveyor is driven by a servo motor that is mounted proximately to the rotary clamp cylinder such that further compression motion of the stacked gloves is not required.

4. A method for inserting and unloading stacked gloves into a packing box, the method comprising:

inserting the stacked gloves into the packing box;

unloading the stacked gloves with an upper belt conveyor rotating in an anti-clockwise direction while a bottom belt conveyor rotates in an opposite, clockwise direction, thereby pushing out the stacked gloves without inducing friction between the stacked gloves and the upper and lower belt conveyors, and without inducing friction from the upper and lower belt conveyors to the packing box during unloading to prevent damage;

lifting the first portion of claim 1 without the stacked gloves from the packing box simultaneously with unloading while the stacked gloves are pushed into the packing box;

wherein the first portion returns to its initial position, and wherein the inserting, the unloading, and the lifting repeat.

5. The method of claim 4, alternative inserting and unloading with the packing box moving towards the first portion.

* * * * *